US006670046B1

(12) United States Patent
Xia

(10) Patent No.: US 6,670,046 B1
(45) Date of Patent: Dec. 30, 2003

(54) THERMAL BARRIER COATING SYSTEM FOR TURBINE COMPONENTS

(75) Inventor: John Yuan Xia, Winter Springs, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 267 days.

(21) Appl. No.: 09/651,935

(22) Filed: Aug. 31, 2000

(51) Int. Cl.[7] ..... B32B 15/04; F03B 3/12

(52) U.S. Cl. ..... 428/469; 428/116; 428/117; 416/241 B; 416/229 R; 416/229 A

(58) Field of Search ..... 428/469, 472, 428/116, 117; 427/453, 566, 585, 593; 416/241 B, 241 R, 224, 229 R, 248, 229 A

(56) References Cited

U.S. PATENT DOCUMENTS

| | | | | |
|---|---|---|---|---|
| 4,576,874 A | * | 3/1986 | Spenglere et al. | 428/623 |
| 4,802,828 A | * | 2/1989 | Rutz et al. | |
| 5,209,645 A | | 5/1993 | Kojima et al. | |
| 5,310,592 A | | 5/1994 | Baker | |
| 5,630,314 A | * | 5/1997 | Kojima et al. | |
| 5,667,641 A | | 9/1997 | Poirier | |
| 5,683,825 A | * | 11/1997 | Bruce et al. | 428/698 |
| 5,910,290 A | | 6/1999 | Hyppanen | |
| 5,967,755 A | | 10/1999 | Czech et al. | |
| 6,235,370 B1 | * | 5/2001 | Merrill et al. | 428/116 |
| 6,382,920 B1 | * | 5/2002 | Dopper | |
| 6,499,943 B1 | * | 12/2002 | Beeck et al. | |

FOREIGN PATENT DOCUMENTS

| | | | |
|---|---|---|---|
| EP | 0139396 A1 | * | 5/1985 |
| EP | 0139396 | | 5/1985 |
| EP | 0980960 | | 2/2000 |
| EP | 1013787 | | 6/2000 |
| EP | 1104872 | | 6/2001 |
| WO | 00/25005 | * | 5/2000 |

OTHER PUBLICATIONS

Patents Abstracts of Japan, vol. 004, No. 187 (M–048), Dec. 23, 1980, JP 55 134702A (Hitachi) Oct. 20, 1980.

* cited by examiner

*Primary Examiner*—Deborah Jones
*Assistant Examiner*—Jennifer McNeil

(57) ABSTRACT

A composite thermal barrier coating system includes a first composite thermal barrier coating over a portion of a substrate, and a second deposited thermal barrier coating over edge portions of the substrate. The first composite coating is relatively thick and preferably includes friable graded insulation comprising an abradable honeycomb metallic structure filled with high thermal expansion ceramic hollow spheres in a phosphate bonded matrix. The second deposited edge coating is relatively thin and preferably comprises an electron beam physical vapor deposited thermal barrier coating comprising $ZrO_2$ and $Y_2O_3$. The friable graded insulation may be manufactured to thicknesses in excess of current thermal barrier coating systems, thereby imparting greater thermal protection. Superior erosion resistance and abrasion properties are also achieved. The composite thermal barrier coating system is useful on combustion turbine components such as ring seal segments, vane segment shrouds, transitions and combustors.

16 Claims, 4 Drawing Sheets

THERMAL BARRIER COATING SYSTEM FOR TURBINE COMPONENTS

FIELD OF THE INVENTION

The present invention relates to abradable thermal barrier coatings, and more particularly relates to the use of such coatings for combustion turbine components such as turbine ring segments.

BACKGROUND INFORMATION

Metal components of combustion turbines are operated at very high temperatures and often require the use of thermal barrier coatings (TBCs). Conventional TBCs typically comprise a thin layer of zirconia. In many applications, the coatings must be erosion resistant and must also be abradable. For example, turbine ring seal segments which fit with tight tolerances against the tips of turbine blades must withstand erosion and must preferentially wear or abrade in order to reduce damage to the turbine blades.

In order to provide sufficient adherence to the underlying metal substrate, conventional TBCs are provided as relatively thin layers, e.g., less than 0.5 mm. This thickness is limited by the thermal expansion mismatch between the coating and metallic substrate. However, such thin layers limit the heat transfer characteristics of the coatings, and do not provide optimal erosion resistance and abrasion properties.

The goal of achieving improved gas turbine efficiency relies upon breakthroughs in several key technologies as well as enhancements to a broad range of current technologies. One of such key issues is to tightly control rotating blade tip clearance. This requires that turbine ring segments, also known as turbine heat shields or turbine outer seals, are able to absorb mechanical rubbing against rotating blade tips.

For closed loop steam cooled turbine ring segments, a thick thermal barrier coating of about 0.1 inch on the ring segment surface is required for rubbing purposes. The latest advanced gas turbine has a hot spot gas temperature of 2,800° F. at the first stage ring segment. Under such a high thermal load, a TBC surface temperature of 2,400° F. is expected. Thus, the conventional abradable TBC is no longer applicable because TBC has a limitation of maximum surface temperature up to 2,100° F.

Electron beam physical vapor deposited thermal barrier coatings (EB-PVD TBCs) are a possible alternative solution for such high surface temperatures. However, EB-PVD TBCs are not very abradable and are not considered satisfactory for conventional turbine ring segment applications.

Friable graded insulation (FGI) comprising a filled honeycomb structure has been proposed as a possible solution to turbine ring segment abrasion. FGI materials are disclosed in U.S. patent application Ser. No. 09/261,721, which is incorporated herein by reference. The use of FGI as an effective abradable is based on the control of macroscopic porosity in the coating to deliver acceptable abradability. The coating consists of hollow ceramic spheres in a matrix of aluminum phosphate. The ability to bond this ceramic coating to a metallic substrate is made possible by the use of high temperature honeycomb alloy which is brazed to a metallic substrate. The honeycomb serves as a mechanical anchor for the FGI filler, and provides increased surface area for chemical bonding. However, one key issue relating to the practical use of FGI honeycomb coatings applications such as turbine ring segments is that the edges and corners of the ring segments are exposed to hot gas convection. Wrapping the filled honeycomb around the edges and corners presents distinct difficulties for manufacturing.

The present invention has been developed in view of the foregoing, and to address other deficiencies of the prior art.

SUMMARY OF THE INVENTION

The present invention provides a high temperature, thermally insulating and/or abradable composite coating system that may be used in gas turbine components such as ring seal segments and the like. The coating system includes a first composite thermal barrier coating covering a portion of the component, and a second deposited thermal barrier coating covering edge portions of the component.

The preferred first composite thermal barrier coating includes a composite material which comprises a metal base layer or substrate, a metallic honeycomb structure, and a ceramic filler material. The ceramic filler material preferably comprises hollow ceramic spheres within a phosphate matrix to provide high temperature capability and excellent thermal insulation. The resulting system is compliant and accommodates differential thermal strains between the ceramic and the metallic substrate material. The honeycomb/ceramic composite may optionally be overlaid with a ceramic layer to protect and insulate the metallic honeycomb.

The second deposited thermal barrier coating covers edge portions of the component, and preferably comprises a combination of zirconia and yttria, e.g., $ZrO_2$-8 wt % $Y_2O_3$. The deposited thermal barrier edge coating is preferably applied by electron beam physical vapor deposition (EB-PVD) techniques. The EB-PVD ceramic preferably has a columnar microstructure which may provide improved strain tolerance. Under mechanical load, or thermal cycling, the ceramic columns produced by EB-PVD can move, both away from each other and towards each other, as strain cycles are applied to a component.

In addition to improved thermal properties, the present coating system displays excellent abradable properties. The honeycomb structure of the first composite coating provides good adhesion between the ceramic material and the underlying metallic substrate/component. By infiltrating the ceramic into the cells of the honeycomb during processing, the honeycomb provides additional mechanical anchoring to enhance ceramic to metal adhesion. The composite enables the use of relatively thick insulating coatings, e.g., on the order of 2 mm or more, to provide very high temperature protection to metallic hot section gas turbine parts.

The coating system in addition to providing adequate abradability also possesses excellent erosion resistance. For example, the ceramic on a ring seal segment should wear preferentially to the metal of a blade in the case of ring seal segment/blade tip rubbing. This property provides the capability to restrict blade tip clearances and to improve engine efficiencies without incurring the damage to blade tips that conventional TBC coatings cause in similar situations.

The present invention provides a more durable, cost effective thermal barrier coating system for use with ring seal segments, transitions, combustors, vane platforms, and the like.

An aspect of the present invention is to provide a thermal barrier coating system comprising a metal substrate, a first composite thermal barrier coating over a portion of the substrate, and a second deposited thermal barrier coating over at least an edge portion of the substrate adjacent a periphery of the first composite thermal barrier layer.

Another aspect of the present invention is to provide a method of making a composite thermal barrier coating. The method includes the steps of covering a portion of a metal substrate with a first composite thermal barrier coating, and depositing a second thermal barrier coating over at least an edge portion of the substrate adjacent a periphery of the first composite thermal barrier layer.

These and other aspects of the present invention will be more apparent from the following description.

DETAILED DESCRIPTION

Figure 1:
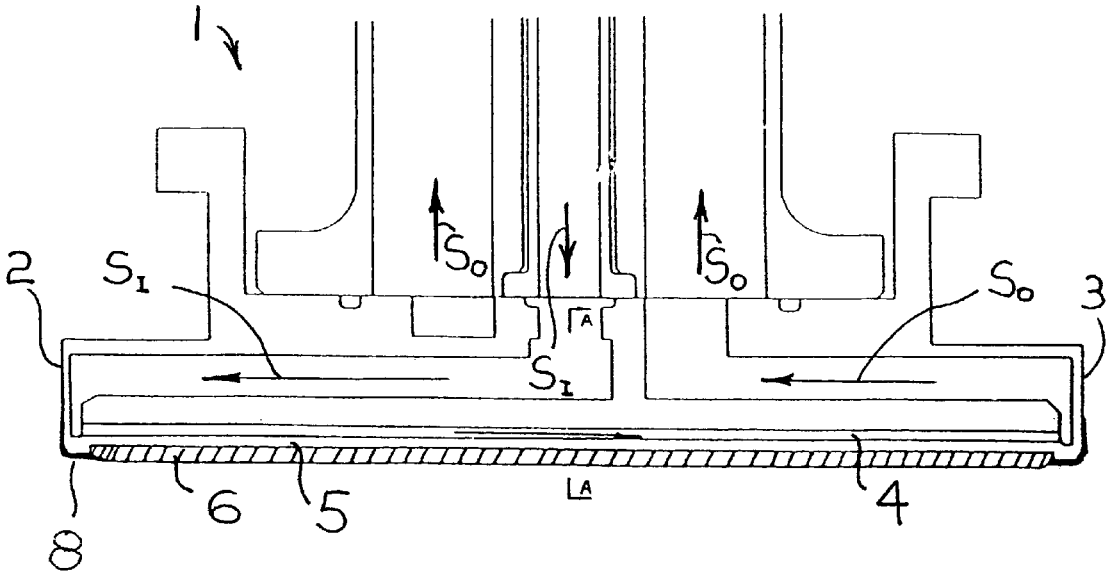
FIG. 1 is a partially schematic sectional view of a closed loop steam cooled turbine ring segment including a thermal barrier coating system in accordance with an embodiment of the invention.
Figure 2:
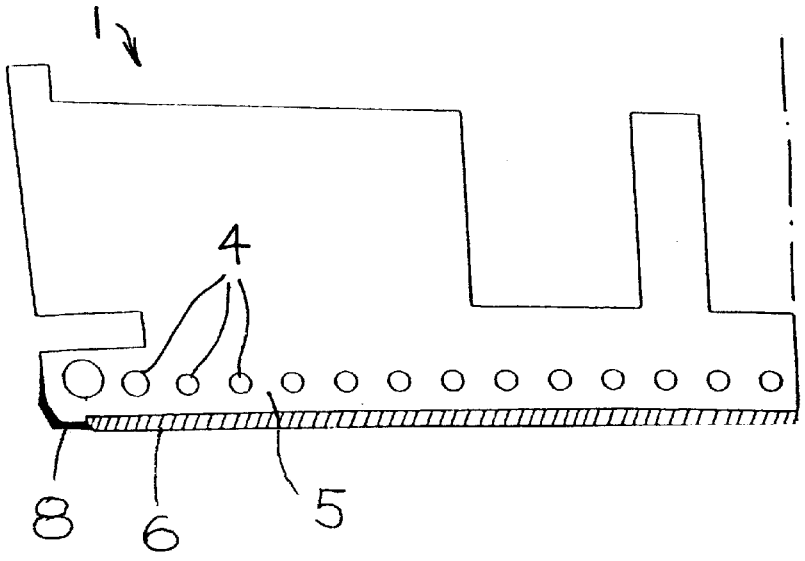
FIG. 2 is a partially schematic sectional view taken through line A—A of FIG. 1.

FIGS. 1 and 2 illustrate a thermal barrier system of the present invention applied to a conventional turbine ring segment. A turbine ring segment 1 includes a leading edge 2 and a trailing edge 3. Steam flows in a known manner in the turbine ring segment 1, as shown in FIG. 1 by arrows $S_I$representing steam in and arrows $S_O$ representing steam out. Turbulatored cooling holes 4 are provided near the surface of the turbine ring segment 1.

As shown in FIGS. 1 and 2, the turbine ring segment 1 includes a substrate 5 which is subjected to very high temperatures during operation of the turbine ring segment 1. In accordance with the present invention, a first composite thermal barrier coating 6 is provided over a portion of the substrate 5. A second deposited thermal barrier coating 8 is provided over the edge portions of the substrate 5 adjacent a periphery of the first composite thermal barrier layer 6. The first composite thermal barrier coating 6 is relatively thick and is provided over the wear or abrasion region of the turbine ring segment 1. The second deposited thermal barrier coating 8 is relatively thin, and is provided on non-rubbing surfaces of the turbine ring segment 1.

In a preferred embodiment, the first composite thermal barrier coating 6 comprises an abradable FGI filled honeycomb composite material as described in U.S. patent application Ser. No. 09/261,721. The FGI layer is preferably brazed on the potential rubbing surface of the component. The honeycomb of the FGI coating 6 is embedded into the substrate 5, which provides advantages such as better brazing strength.

The second deposited thermal barrier coating 8 preferably comprises an EB-PVD ceramic such as zirconia and yttria, wherein the zirconia comprises most of the ceramic on a weight percent basis. For example, the ceramic may preferably comprise from 1 to 20 weight percent $Y_2O_3$, with the balance $ZrO_2$ and minor amounts of dopants and impurities. A particularly preferred EB-PVD TBC composition is $ZrO_2$-8 wt % $Y_2O_3$.

Figure 3:
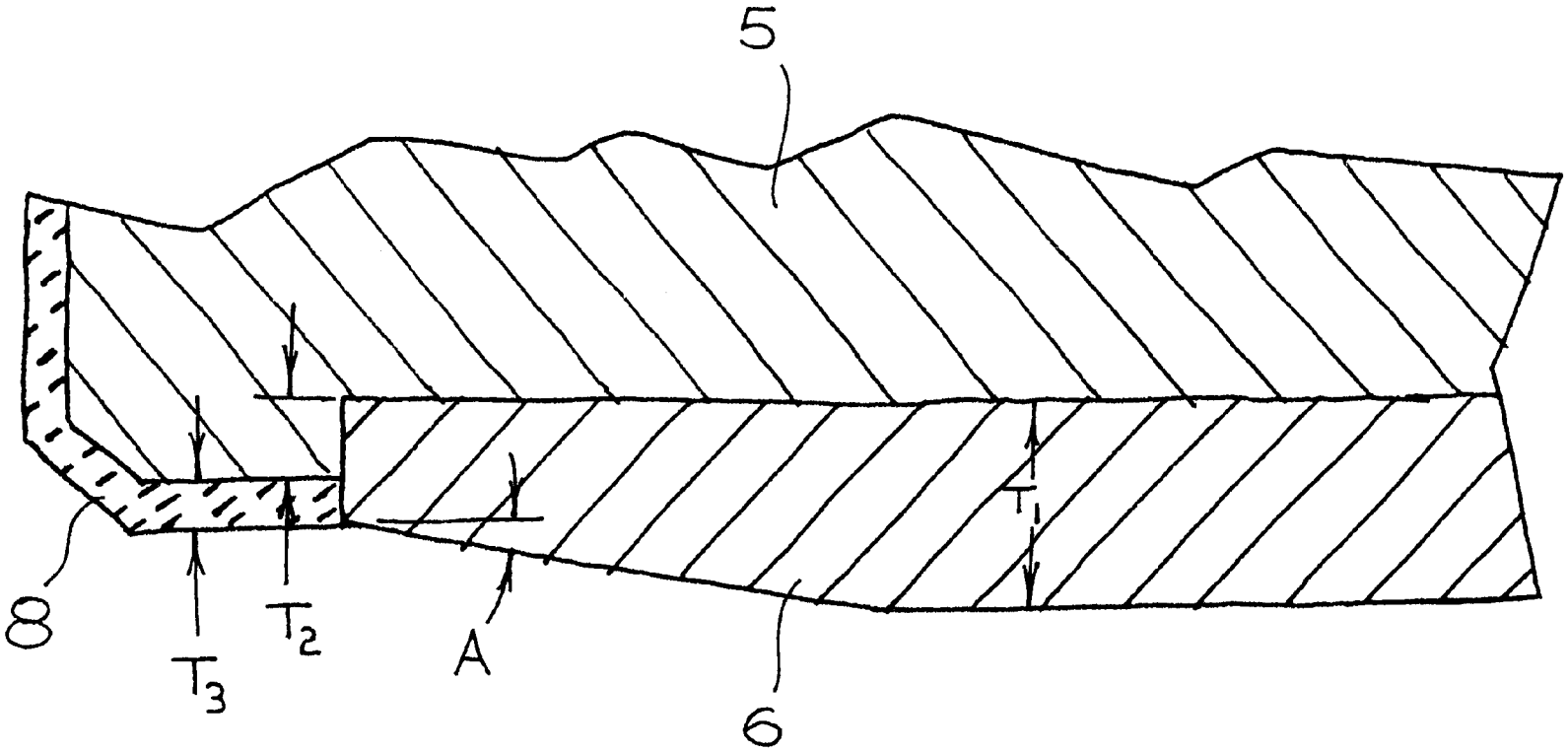
FIG. 3 is an enlarged sectional view of the left edge region of FIG. 2, showing details of the thermal barrier coating system.

FIG. 3 is an enlarged sectional view of the left edge region of the turbine ring segment 1 of FIG. 2. The first composite thermal barrier coating 6 has a thickness of $T_1$, and is embedded a distance of $T_2$ in a recessed region of the substrate 5. The embedded distance $T_2$ is typically from about 10 to about 80 percent of the thickness $T_1$, preferably from about 20 to about 50 percent. The second deposited thermal barrier coating 8 has a thickness of $T_3$, and is provided over the non-recessed edge region of the substrate 5. The thickness $T_3$ is typically from about 5 to about 50 percent of the thickness $T_1$, preferably from about 10 to about 30 percent.

The thickness $T_1$ of the first composite thermal barrier coating 6 preferably ranges from about 1 to about 6 mm, more preferably from about 2 to about 4 mm. The recess or embedded distance $T_2$ is preferably from about 0.5 to about 3 mm, more preferably from about 0.7 to about 2 mm. The thickness $T_3$ of the second deposited thermal barrier coating 8 preferably ranges from about 0.2 to about 1 mm, more preferably from about 0.3 to about 0.7 mm.

As shown most clearly in FIG. 3, the peripheral region of the FGI composite thermal barrier coating 6 is tapered to provided edges which are covered by the deposited coating 8. The coating 6 is preferably tapered at an angle A of from about 5 to about 10 degrees measured from the plane of the underlying substrate 5 upon which the FGI coating 6 is applied.

As an example, for application to a conventional first stage ring segment, a TBC system with the following dimensions can meet design objectives: FGI filled honeycomb thickness $T_1$ of 0.12 inch; embedded honeycomb thickness $T_2$ within substrate of 0.04 inch; taper angle A of 7 degrees; EB-PVD TBC composition of $ZrO_2$-8 wt % $Y_2O_3$; and EB-PVD TBC thickness $T_3$ of 0.02 inch.

Figure 4:
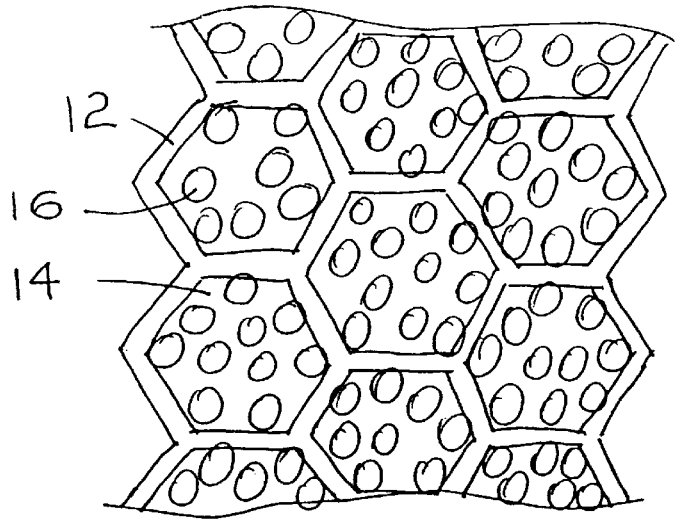
FIG. 4 is a partially schematic top view of a composite thermal barrier coating which may be used in accordance with an embodiment of the present invention.

FIG. 4 is a partially schematic top view of an FGI composite thermal barrier coating which may be used in the coating system of the present invention. The composite thermal barrier coating includes a metal support structure 12 in the form of a honeycomb having open cells. A ceramic filler material including a ceramic matrix 14 with hollow ceramic particles 16 contained therein fills the cells of the honeycomb 12. Although a honeycomb support structure 12 is shown in FIG. 4, other geometries which include open cells may be used in accordance with the present invention.

The cells of the honeycomb 12 preferably have widths of from about 1 to about 7 mm. The wall thickness of the honeycomb 12 is preferably from about 0.1 to about 0.5 mm. The honeycomb 12 preferably comprises at least one metal, for example, an iron based oxide dispersion strengthened (ODS) alloy such as PM2000 or a high temperature nickel superalloy such as Nimonic 115 or Inconel 706. PM2000 comprises about 20 weight percent Cr, 5.5 weight percent A1, 0.5 weight percent Ti, 0.5 weight percent $Y_2O_3$, and the balance Fe. Nimonic 115 comprises about 15 weight percent Cr, weight percent Co, 5 weight percent A1, 4 weight percent Mo, 4 weight percent Ti, 1 weight percent Fe, 0.2 weight percent C, 0.04 weight percent Zr, and the balance Ni. Inconel 706 comprises about 37.5 weight percent Fe, 16 weight percent Cr, 2.9 weight percent Co, 1.75 weight percent Ti, 0.2 weight percent A1, 0.03 weight percent C, and the balance Ni.

The walls of the honeycomb 12 preferably include an oxide surface coating having a thickness of from about 0.005 to about 5 microns. The oxide surface coating may comprise metal oxides such alumina, titania, yttria and other stable oxides associated with the composition of the honeycomb material.

The ceramic matrix 14 of the ceramic filler material preferably comprises at least one phosphate such as monoaluminum phosphate, yttrium phosphate, lanthanum phosphate, boron phosphate, and other refractory phosphates or non phosphate binders or the like. The ceramic matrix 14 may also include ceramic filler powder such as mullite, alumina, ceria, zirconia and the like. The optional ceramic filler powder preferably has an average particle size of from about 1 to about 100 microns.

As shown in FIG. 4, the hollow ceramic particles 16 are preferably spherical and comprise zirconia, alumina, mullite, ceria YAG or the like. The hollow ceramic spheres 16 preferably have an average size of from about 0.2 to about 1.5 mm.

Figure 5:
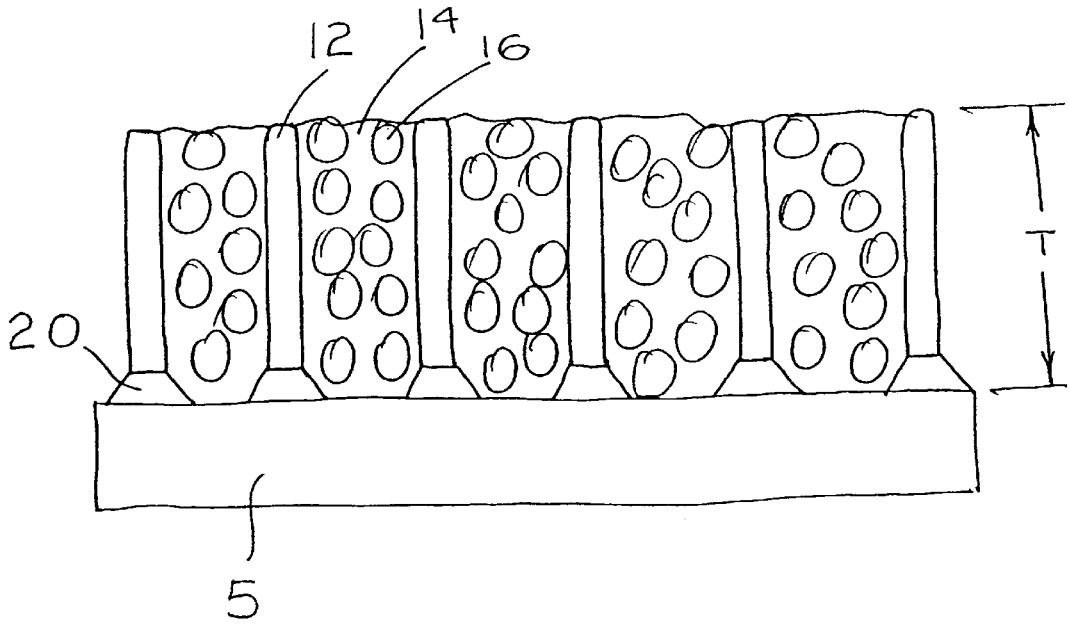
FIG. 5 is a partially schematic side sectional view of a composite thermal barrier coating which may be used in accordance with an embodiment of the present invention.

FIG. 5 is a partially schematic side sectional view of a composite thermal barrier coating which may be used in a coating system in accordance with an embodiment of the present invention. The honeycomb support structure 12, ceramic matrix 14 and hollow ceramic particles 16 are secured to the metal substrate 5, e.g., an alloy such any nickel based superalloy, cobalt based superalloy, iron based superalloy, ODS alloys or intermetallic materials. A braze material 20 is preferably used to secure the composite coating to the substrate 5. The braze material 20 may comprise a material such AMS 4738 or MBF100 or the like. Although in the embodiment of FIG. 5 a braze 20 is used to secure the composite thermal barrier coating to the substrate 5, any other suitable means of securing the coating to the substrate may be used. In a preferred embodiment, the metal substrate 5 comprises a component of a combustion turbine, such as a ring seal segment or the like.

For many applications, the thickness $T_1$ of the composite thermal barrier coating, including the metal support structure and the ceramic filler material, is preferably from about 1 to about 6 mm, more preferably from about 2 to about 4 mm. However, the thickness $T_1$ can be varied depending upon the specific heat transfer conditions for each application.

Figure 6:
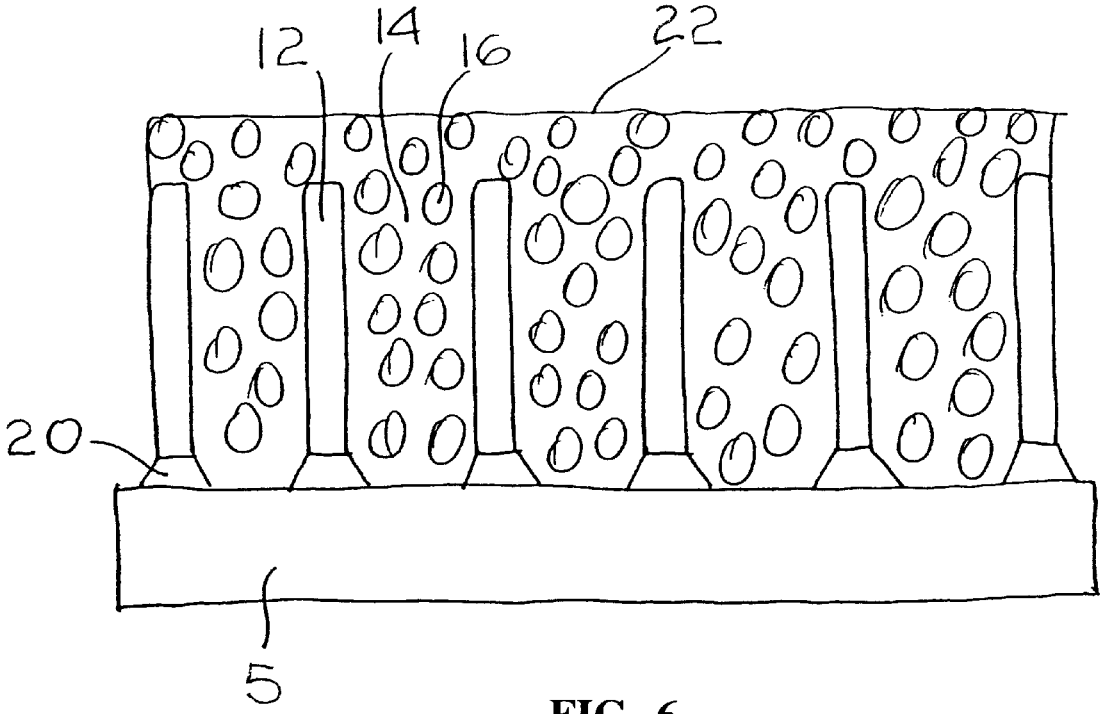
FIG. 6 is a partially schematic side sectional view of a composite thermal barrier coating which may be used in accordance with another embodiment of the present invention.

In the embodiment shown in FIG. 5, the ceramic filler material 14, 16 substantially fills the cells of the honeycomb 12. In an alternative embodiment shown in FIG. 6, an additional amount of the ceramic filler material is provided as an overlayer 22 covering the honeycomb 12. In the embodiment shown in FIG. 6, the overlayer 22 is of substantially the same composition as the ceramic filler material 14, 16 which fills the cells of the honeycomb 12. Alternatively, the overlayer 22 may be provided as a different composition. The thickness of the overlayer 22 is preferably from about 0.5 to about 2 mm and is generally proportional to the thickness of the honeycomb beneath.

Figure 7:
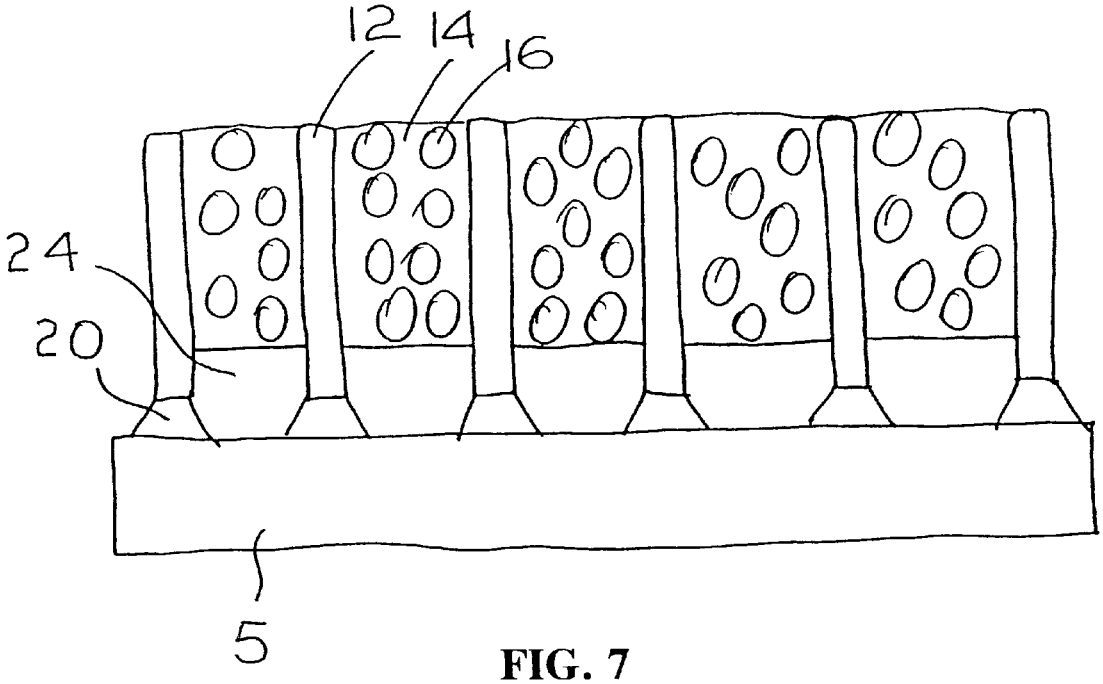
FIG. 7 is a partially schematic side sectional view of a composite thermal barrier coating which may be used in accordance with a further embodiment of the present invention.

FIG. 7 illustrates another embodiment of the present invention in which an intermediate layer 24 is provided between the substrate 5 and the ceramic filler material 14, 16. In this embodiment, the intermediate layer 24 may comprise a void or a low density filler material such as a fibrous insulation or the like. The intermediate layer provides additional thermal insulation to the substrate material and may also contribute to increased compliance of the coating. The thickness of the intermediate layer 24 preferably ranges from about 0.5 to about 1.5 mm.

In accordance with the present invention, the FGI composite thermal barrier coating is capable of operating in heat fluxes comparable to conventional thin APS thermal barrier coatings ($1–2\times10^6$ W/m$^2$). However, its benefit lies in the ability to reduce these heat fluxes by an order-of-magnitude via the increased thickness capability with respect to conventional TBCs. Cooling requirements are reduced correspondingly, thereby improving engine thermodynamic efficiency.

The FGI composite thermal barrier coating preferably has particle erosion resistance which is equivalent or superior to conventional TBCs applied by thermal spraying. Erosion rates measured for a baseline version of the FGI are compared below to conventional TBCs and conventional abradable coatings applied by thermal spraying.

TABLE 1

Steady-State Erosion Rates for Back-Filled Honeycomb Thermal Barrier Coating

| Test Conditions | |
|---|---|
| Particle size | 27 microns |
| Particle Type | $Al_2O_3$ |
| Impact Velocity | 900 ft/s |
| Impingement angle | 15° |
| Test Temperature | 2350° F. |

Test Results

| FGI | Conventional TBC | Conventional Abradable Coating |
|---|---|---|
| 3.2 | 4.6–8.6 | 50–60 |

g/kg (grams target lost / kilogram erosive media impacting)

The measure of abradability of the FGI baseline version is shown below on the basis of volume wear ratio (VWR). The abradability is comparable to that of conventional abradable coatings applied by thermal spray. The advantages offered by the FGI are: mechanical integrity due to the metallurgical bond to the substrate and the compliance offered by the honeycomb; and superior erosion resistance, e.g., greater than ten times better than conventional coatings.

TABLE 2

VWR Abradability Comparison of FGI vs. Conventional Abradable Coating

| Contacting blade condition | FGI | Conventional Abradable (APS-YSZ) |
|---|---|---|
| Untreated blade tips | 2 | 2.5 |
| CBN-coated blades tips | 15–40 | 250 |

*VWR = seal wear volume / blade tip wear volume

Note: The baseline version of the FGI was not optimized for abradability.

In accordance with a preferred embodiment of the present invention, the FGI honeycomb may be brazed to the surface of the metal substrate using conventional high temperature braze foils or powders such as MBF 100, a cobalt based braze for iron based ODS alloys or Nicrobraze 135 for nickel superalloys. MBF 100 comprises about 21 weight percent Cr, 4.5 weight percent W, 2.15 weight percent B, 1.6 weight percent Si, and the balance Co. Nicrobraze 135 comprises about 3.5 weight percent Si, 1.9 weight percent B, 0.06 weight percent C, and the balance Ni. Brazing is preferably carried out in a vacuum furnace at a temperature of from about 900 to about 1,200° C. for a time of from about 15 to about 120 minutes.

After the honeycomb has been brazed to the surface of the metal substrate it is preferably partially oxidized to form an oxide coating on the honeycomb surface in order to aid bonding of the ceramic filler material. Partial oxidation of the surface of the honeycomb can be achieved by post braze heat treatment in air or during the brazing cycle if the vacuum is controlled to approximately $10^{-4}$ Torr.

The cells of the honeycomb are then at least partially filled with a flowable ceramic filler material comprising the hollow ceramic particles and the binder material, followed by heating the flowable ceramic filler material to form an interconnecting ceramic matrix in which the hollow ceramic particles are embedded. The flowable ceramic filler material preferably comprises the hollow ceramic particles and a matrix-forming binder material dispersed in a solvent. The solvent used for forming the phosphate binder solution is water. The solvent preferably comprises from about 30 to about 60 weight percent of the flowable ceramic material. Alternatively, the flowable ceramic filler material may be provided in powder form without a solvent. The flowable ceramic filler material is preferably packed into the open cells of the honeycomb using a combination of agitation and manually assisted packing using pushrods to force pack the honeycomb cells ensuring complete filling. Alternate packing methods such as vacuum infiltration, metered doctor blading and similar high volume production methods may also be used.

After the cells of the honeycomb support structure are filled with the flowable ceramic filler material, the material may be dried in order to substantially remove any solvent. Suitable drying temperatures range from about 60 to about 120° C.

After the filling and optional drying steps, the flowable ceramic filler material is heated, preferably by firing at a temperature of from about 700 to about 900° C, for a time of from about 60 to about 240 minutes. The firing temperature and time parameters are preferably controlled in order to form the desired interconnecting ceramic matrix embedding the hollow ceramic particles. Upon firing, the ceramic matrix preferably comprises an interconnected skeleton which binds the hollow ceramic particles together. The resultant ceramic matrix preferably comprises oxide filler particles bonded by a network of aluminum phosphate bridging bonds In a preferred method, a flowable green body of phosphate based ceramic filler containing monoaluminum phosphate solution, ceramic filler powder (such a mullite, alumina, ceria or zirconia) and hollow ceramic spheres in a preferred size range of from about 0.2 to about 1.5 mm is applied into the honeycomb until it comes into contact with the substrate base. The green formed system is then dried to remove remaining water and subsequently fired to form a refractory, insulative ceramic filler that fills the honeycomb cells. The ceramic filler material acts as a thermal protection coating, an abradable coating, and an erosion resistant coating at temperatures up to about 1,100° C. or higher. A ceramic overcoating, such as a phosphate based overcoating of similar composition to the backfilled honeycomb ceramic filler material or an alternative ceramic coating such as air plasma sprayed or PVD, may optionally be applied.

The phosphate binder may bond to the oxide scale both at the substrate base and on the honeycomb walls. Due to mismatches in expansion coefficients, some ceramic surface cracking may occur, but the bonding and mechanical anchoring to the honeycomb is sufficient to retain the ceramic filler material within the hexagonal cells of the honeycomb. Intercellular locking may also be achieved by introducing holes into the honeycomb cell walls to further encourage mechanical interlocking. Furthermore, the honeycomb may be shaped at an angle that is not perpendicular to the surface of the substrate in order to improve composite thermal behavior and to increase mechanical adhesion.

To improve bonding to the substrate base, a plasma sprayed coating such as alumina or mullite may be applied to the metallic materials prior to deposition of the ceramic filler material. After firing the coating may optionally be finish machined to the desired thickness. The coating may be back-filled with a phosphate bond filler and refined if smoother finishes are required.

The following example is intended to illustrate various aspects of the present invention, and is not intended to limit the scope of the invention.

EXAMPLE

A specific combination of the following materials can be used to manufacture a FGI composite coating: X-45 cobalt based superalloy substrate material; PM2000 FGI Honeycomb (125 microns wall thickness, 4 mm depth and 3.56 mm cell size); MBF 100 Braze Foil; 50% aqueous solution of monoaluminum phosphate; KCM73 sintered mullite powder (25 microns particle size) and alumina hollow spheres (1.6 g/cc bulk density, sphere diameter 0.3 to 1.2 mm). The honeycomb is brazed to the surface substrate using established vacuum brazing techniques. The MBF 100 braze foil is cut to shape and accurately placed underneath the honeycomb part and then positioned onto the substrate. The honeycomb/foil assembly is then resistance brazed in air to the substrate to tack the honeycomb into position. The tacking of the honeycomb to the substrate is to prevent the honeycomb from springing back and away from the substrate surface during the brazing cycle. Vacuum brazing is then carried out to the schedule listed in Table 3.

TABLE 3

| Ramp Rate | Temperature (±4° C.) | Time |
|---|---|---|
| 4° C./min | 1066° C. | Hold for 10 mins |
| 4° C./min | 1195° C. | Hold for 15 mins |
| Furnace cool | 1038° C. | |
| Force cool using $N_2$ gas | 93° C. | |

The next stage of the process involves preparation of the slurry that will be used to bond the spheres into the honeycomb cells. The slurry consists of 49.3 weight percent aqueous solution of monoaluminum phosphate and 50.7 weight percent KCM73 mullite powder. The two constituents are mixed in an inert container until the powder is thoroughly dispersed into the aqueous solution. The solution is then left for a minimum of 24 hours to dissolve any metallic impurities from the powder.

The slurry is then applied to the surface of the brazed honeycomb to form a dust coating on the surface of the cell walls. This is applied using an air spray gun at approximately 20 psi pressure. The dust coating serves as a weak adhesive to contain the ceramic hollow spheres. The next stage of the process involves the application of the spheres into the wetted honeycomb cells. Enough spheres are administered to fill approximately one-third to one-half the volume of the cells. Application of the spheres is not necessarily a metered process. A pepper pot approach can be applied with reasonable care and attention paid to the amount going into the individual cells. After the correct amount of spheres are applied, a stiff bristled tamping brush is then used to force pack the spheres into the cells ensuring no gaps or air pockets are left in the partially packed cells. After tamping has been completed, the aforementioned process is repeated until the packing cells are completely filled with well packed spheres. The slurry spraying and sphere packing needs to be repeated once or twice to achieve filled spheres. When the spheres are filled, a saturating coating of slurry is applied to ensure the filling of any remaining spaces with the soaking action of the slurry. Parts of the substrate may be masked off in order to avoid contact with the slurry if needed.

After the wet filling operation has been completed, the wet green body is left to dry in air at ambient temperature for between 24 to 48 hours. It is then subjected to the following thermal treatment in air to form the refractory, bonded body to which the invention discussed herein pertains.

TABLE 4

| Start Temp (° C.) | Ramp Rate (° C./min) | Hold Temperature (° C.) | Dwell Time (Hours) |
|---|---|---|---|
| 80 | — | 80 | 48 |
| 80 | 1 | 130 | 1 |
| 130 | 1 | 800 | 4 |
| 800 | 10 | ambient | — |

Following firing the surface of the backfilled honeycomb may be machined to specified tolerances using diamond grinding media and water as a lubricant. For example, the FGI may be machined to the desired thickness $T_1$ and taper angle A, as shown in FIG. 3. The EB-PVD layer may then be deposited to the desired thickness by standard EB-PVD techniques known in the art.

Thermal modeling of the present system using a one-dimensional heat transfer model show the benefit of the thick honeycomb type coatings in comparison with conventional thin APS type coatings. A conductivity of 2.5 W/mK is used for the back-filled filled honeycomb, as derived from the relative volume fractions of ceramic filler and metallic honeycomb. For a wide range of hot side heat transfer conditions (spanning the range of hot turbine components from combustors to vanes), the present system offers significant performance benefit (from 30% to>90% cooling air savings). These benefits are possible with or without overlayer coatings. However, with reasonable overlayer coating thicknesses, the benefit is increased substantially at the lower range of heat transfer conditions.

The present coating system can be applied to substantially any metallic surface in a combustion turbine that requires thermal protection to provide survivability of the metal. It provides the capability to apply very thick surface coatings in abrasion to allow for very high gas path temperatures and greatly reduced component cooling air. In addition to ring seal segments, transitions and combustors, the system may be applied to planar hot gas washed surfaces of components, such as the inner and outer shrouds of vane segments.

Whereas particular embodiments of this invention have been described above for purposes of illustration, it will be evident to those skilled in the art that numerous variations of the details of the present invention may be made without departing from the invention as defined in the appended claims.

What is claimed is:

1. A thermal barrier coating system, comprising:

a metal substrate;

a first composite ceramic-comprising thermal barrier coat over a first portion of the substrate capable of withstanding temperatures in excess of 1500° F.;

a second ceramic-comprising thermal barrier coating over at least an edge portion of the substrate adjacent a periphery of the first composite thermal barrier coating and capable of withstand temperature in excess of 1500° F.; and wherein the first composite thermal barrier coating is embedded in a recessed portion of the metal substrate.

2. The thermal barrier coating system of claim 1, wherein the first composite thermal barrier coating is embedded in the substrate a distance of from about 10 to about 80 percent of the thickness of the first composite thermal barrier coating.

3. The thermal barrier coating system of claim 1, wherein the first composite thermal barrier coating is embedded in the substrate a distance of from about 20 to about 50 percent of the thickness of the first composite thermal barrier coating.

4. A thermal barrier coating system, comprising:

a metal substrate;

a first composite ceramic-comprising thermal barrier coating over a first portion of the substrate capable of withstanding temperatures in excess of 1500° F.;

a second ceramic-comprising thermal barrier coat over at least an edge portion of the substrate adjacent a periphery of the first composite thermal barrier coating, and capable of withstanding temperatures in excess of 1500° F.;

wherein a peripheral region of the first composite thermal barrier coating has a thickness less than the thickness of the remainder of the first composite thermal barrier coating; and wherein the peripheral region is tapered at an angle of from about 5 to about 10 degrees measured from a plane defined by the underlying metal substrate.

5. A method of making a composite thermal barrier coating system, comprising:

covering a portion of a metal substrate with a first composite ceramic-comprising thermal barrier coating capable of withstanding temperatures in excess of 1500° F.; and depositing a second ceramic-comprising thermal barrier coating over at least an edge portion of the substrate adjacent a periphery of the first composite thermal barrier coating and capable of withstanding temperatures in excess of 1500° F.; and wherein the first composite thermal barrier coating is embedded in a recess in the metal substrate, and has a thickness greater than a thickness of the second deposited thermal barrier coating.

6. A thermal barrier coating system, comprising:

a metal substrate;

a first composite ceramic-comprising thermal barrier coating over a portion of the substrate capable of withstanding temperatures in excess of 1500° F.;

a second ceramic-comprising thermal barrier coating over a second portion of the substrate and generally adjacent the first portion of the substrate and capable of withstanding temperatures in excess of 1500° F.; and wherein the first composite thermal barrier coating comprises a metal support structure including honeycomb having open cells.

7. The thermal barrier coating system of claim 6, wherein the cells are filled with a ceramic filler material comprising a ceramic matrix with ceramic particles contained therein.

8. A thermal barrier coating system for a combustion turbine engine ring segment, the thermal barrier coating system comprising:

a first thermal barrier coat disposed over a non-rubbing portion of the ring segment to a first thickness; and a second thermal barrier coating disposed over an abrasion portion of the ring segment to a second thickness greater than the first thickness, the second thermal barrier coating comprising a metal support structure extending through at least a portion of the second thickness for supporting the second thickness of thermal barrier coating.

9. The thermal barrier coating system of claim 8, wherein the metal support structure comprises a metal structure bonded to the abrasion portion of the ring segment and defining a plurality of open cells.

10. The thermal barrier coating system of claim 9, wherein the non-rubbing portion of the ring segment comprises an edge surrounding the abrasion portion of the ring segment.

11. The thermal barrier coating system of claim 8, wherein the metal support structure comprises a metal structure broad onto the abrasion portion of the ring segment and defining a honeycomb of open cells.

12. The thermal barrier coating of claim 8, further comprising:

a recessed region formed in the ring sent for receiving the second thermal barrier coating; and the first thermal barrier coating being disposed over a non-recessed portion of the ring segment adjacent the recessed portion.

13. The thermal barrier coating of claim 12, wherein a depth of the recessed portion is from 10–80% of the second thickness.

14. The thermal barrier coating of claim 12, wherein a depth of the recessed portion is from 20–50% of the second thickness.

15. The thermal barrier coating system of claim 8, further comprising a peripheral region of the second thermal barrier coating comprising a tapered thickness.

16. A thermal barrier coating system comprising:

a first thermal barrier disposed over a first portion of a substrate, the first thermal barrier comprising a metal support structure bonded to a generally planar portion of the substrate and extending through at least a portion of a thickness of the first thermal barrier for supporting the first thermal barrier from the substrate; and a second thermal barrier disposed on an edge portion of the substrate adjacent the first portion.

* * * * *